US005373665A

United States Patent [19]

Lyons, Sr.

[11] Patent Number: 5,373,665

[45] Date of Patent: Dec. 20, 1994

[54] DOOR ASSEMBLY WITH AUGMENTED COUNTERBALANCING

[75] Inventor: Robert J. Lyons, Sr., Hamden, Conn.

[73] Assignee: The Bilco Company, West Haven, Conn.

[21] Appl. No.: 45,964

[22] Filed: Apr. 9, 1993

[51] Int. Cl.[5] ..... E05F 1/10

[52] U.S. Cl. ..... 49/386; 16/308

[58] Field of Search ..... 49/386, 366, 367, 379; 16/298, 299, 308; 267/154

[56] References Cited

U.S. PATENT DOCUMENTS

| | | | |
|---|---|---|---|
| 2,174,989 | 10/1939 | Lyons | 94/36 |
| 2,603,819 | 7/1952 | Lyons, Jr. et al. | 16/80 |
| 2,605,494 | 8/1952 | Lyons, Jr. et al. | 16/1 |
| 2,742,662 | 4/1956 | Lyons | 16/1 |
| 2,783,495 | 3/1957 | Vigmostad | 16/308 |
| 2,939,738 | 6/1960 | Lyons | 292/272 |
| 3,067,453 | 12/1962 | Lyons | 16/180 |
| 3,516,210 | 6/1970 | Jentoft et al. | 49/386 X |
| 4,133,074 | 1/1979 | Schack | 49/386 X |
| 4,291,501 | 9/1981 | Steinberg et al. | 49/386 |
| 4,419,789 | 12/1983 | Matsui et al. | 16/308 |
| 4,873,791 | 10/1989 | Lyons, Sr. | 49/386 |
| 5,136,811 | 8/1992 | Lyons, Sr. | 49/386 |
| 5,205,073 | 4/1993 | Lyons, Sr. | 49/386 |

OTHER PUBLICATIONS

1991 Bilco Catalog (New Haven, Connecticut).

*Primary Examiner*—Peter M. Cuomo
*Assistant Examiner*—Jerry Redman
*Attorney, Agent, or Firm*—DeLio & Peterson

[57] ABSTRACT

A counterbalancing assembly and a non-vertically hinged door assembly incorporating the same include a first pair of torque rods directly connected between the door and a frame which produce a partial counterbalancing torque. A second pair of torque rods acting through cams produce an augmenting counterbalancing torque such that the sum of the partial and augmenting torques fully counterbalance the door throughout its arc of motion.

22 Claims, 4 Drawing Sheets

DOOR ASSEMBLY WITH AUGMENTED COUNTERBALANCING

BACKGROUND OF THE INVENTION

1. Field of the Invention

This invention relates to non-vertically hinged doors and associated counterbalancing mechanisms. More particularly, it relates to counterbalancing mechanisms which substantially exactly counterbalance the weight of the door at all angles throughout its arc of motion.

2. Description of Related Art

There are numerous applications in which a door is mounted with a non-vertical hinge line and requires counterbalancing. Such applications include, among others, hatch covers for roof openings, flush mounted sidewalk doors, and exterior basement entrance doors.

Doors for use in these applications are often made of metal, for strength and durability and, accordingly, can be quite heavy. Counterbalancing allows the door to be opened and closed more easily, and improves safety by reducing the tendency of the door to close rapidly and with great force when released.

Typically, partial counterbalancing has been derived from one or more torque rods, springs, gas cylinders or weights. Torque rods have been particularly widely used because they provide a counterbalancing torque as a result of the rotation of one end of the rod relative to the other. Thus, the opposite ends of the torque rod may be connected to the door and the door frame, respectively, to provide a simple, but reliable, counterbalancing mechanism. Through appropriate selection of the torque rod diameter and length, a variety of doors of different weights and sizes may be approximately counterbalanced with this direct connection method.

Torque rods also have the advantage that their long, thin shape can be positioned out of the way behind, or within the thickness of the door frame, producing a door assembly that takes the minimum space when held in inventory and is easy to transport through the distribution chain. Moreover, torque rods are extremely rugged and reliable, an important consideration in doors which are often used for exterior access or in exposed locations.

However, a torque rod counterbalancing design using the simple direct connection between door and frame does not provide perfect counterbalancing. This is because a torque rod provides a counterbalancing torque which, in the usual operating range, is linearly proportional to the amount of rotation or twist applied to it. In contrast, a non-vertically hinged door requires a counterbalancing torque which is non-linearly related to the opening angle of the door. The weight of the door unsupported by a non-vertical hinge line increases as a sinusoidal function of the opening angle.

As a result, counterbalancing systems using torque rods directly connected between the door and the frame only provide exact counterbalancing for the door at two different opening angles of the door. These angles may be found on a graph of torque (measured at the hinge line) versus opening angle (zero degrees equals closed) where the line of torque rod generated counterbalancing torque intersects the cosine curve of the torque due to the unsupported weight of the door. For a horizontally hinged door, the entire weight of the door is unsupported by the hinge when the door is just being opened, and all the weight is supported by the hinge as it reaches the fully open, ninety degree, position.

While the specific two opening angles where the door is exactly counterbalanced in a linear counterbalancing system are under the designer's control, they have usually been selected to be at approximately the fully open and fully closed positions. At the fully open position no counterbalancing torque is required, and the torque rod is not twisted. At the fully closed position, the torque rod is adjusted to provide the exact counterbalance torque required for the full weight of the door. Unfortunately, except at these two angles, the door is insufficiently counterbalanced and may begin to move if released.

In addressing this deficiency, subsequent designs for counterbalancing systems have used a cam system with single or multiple torque rods to nearly exactly counterbalance the door throughout its range of motion. In these designs, the torque rod is not directly connected between the door and the frame, but instead acts through a cam which modifies the linear torque produced by the torque rod to match the sinusoidal torque needed to balance the weight of the door. Doors with counterbalancing mechanisms of the cam-based type are seen in U.S. Pat. Nos. 4,873,791 and 5,136,811.

In such cam-based designs, the entire counterbalancing force for the door is applied through the cam mechanism. The present invention, however, uses a hybrid direct connection/cam based design. A portion of the counterbalancing torque is produced by one or more torque rods directly connected between the door and the door frame, and the remainder of the counterbalancing torque (the "augmenting" torque), as needed to provide nearly exact sinusoidal counterbalancing, is applied by one or more additional torque rods through a cam system.

By applying the majority of the counterbalancing torque with the directly connected torque rod, less force passes through the cam system, which reduces friction and wear as compared to earlier designs. Another advantage lies in the flexibility of the choices available in a hybrid direct connection/cam based torque rod design. Because torque rods are often available only in standard diameters, it may be difficult to match the counterbalance requirements of some doors. With the hybrid design, differently sized torque rods may be combined to optimally match the counterbalancing requirements of a wide variety of doors.

Yet another advantage lies in the fact that the augmenting torque rod counterbalancing system may be provided as a factory installed option to a door also sold with only direct torque rod counterbalancing, or it may be used as an add on field installed accessory for an existing directly counterbalanced door.

Bearing in mind the above, it is therefore an object of the present invention to provide a new and improved counterbalanced door and counterbalancing assembly in which the counterbalancing is performed in part by a counterbalancing mechanism producing linear counterbalancing and in part by an augmenting counterbalancing mechanism to counterbalance the door throughout its arc of motion.

SUMMARY OF THE INVENTION

The invention comprises a counterbalancing assembly for augmenting the counterbalancing of a partially counterbalanced door and a complete door assembly incorporating the counterbalancing assembly. The door assembly includes a frame, a door hinged to the frame along a non-vertical hinge axis for motion from an open position to a closed position and a first counterbalancing means connected between the door and the frame which produces a partial counterbalancing torque about the hinge axis. The first counterbalancing means may comprise a torque rod, or any other linear counterbalancing mechanism, and may be connected directly between the frame and the door or between the hinge leaves of the hinge mechanism upon which the door is hinged.

The door assembly further includes an augmenting counterbalancing system comprising a cam having a cam surface and a second counterbalancing means which applies a force to the cam surface to produce the augmenting counterbalancing torque about the hinge axis of the door. The sum of the partial counterbalancing from the first counterbalancing means and the augmenting counterbalancing torque counterbalances the door between the open and the closed positions.

In the preferred design, the first and second counterbalancing means are torque rods which are twisted in opposite directions as the door swings from the open to the closed position. The second torque rod is mounted with a first end non-rotatably connected to the frame and a second end rotatably connected to the frame. A portion of the second torque rod is bent outward from the axis of rotation of the second end and contacts the cam surface at a point displaced from the axis of rotation to provide the augmenting torque.

In the most highly preferred design, there are a total of four torque rods in the counterbalancing assembly. The first counterbalancing means includes first and third torque rods, forming a pair, directly connected between the door and the frame. The second counterbalancing means includes second and fourth torque rods, forming a second pair, which act against first and second cam surfaces to produce the augmenting torque.

The first and second cams are preferably integrally formed as part of the door hinges. The hinges may be formed as gooseneck hinges such that the hinge axis of the door is located beneath a portion of the frame.

DESCRIPTION OF THE PREFERRED EMBODIMENT(s)

Figure 1:
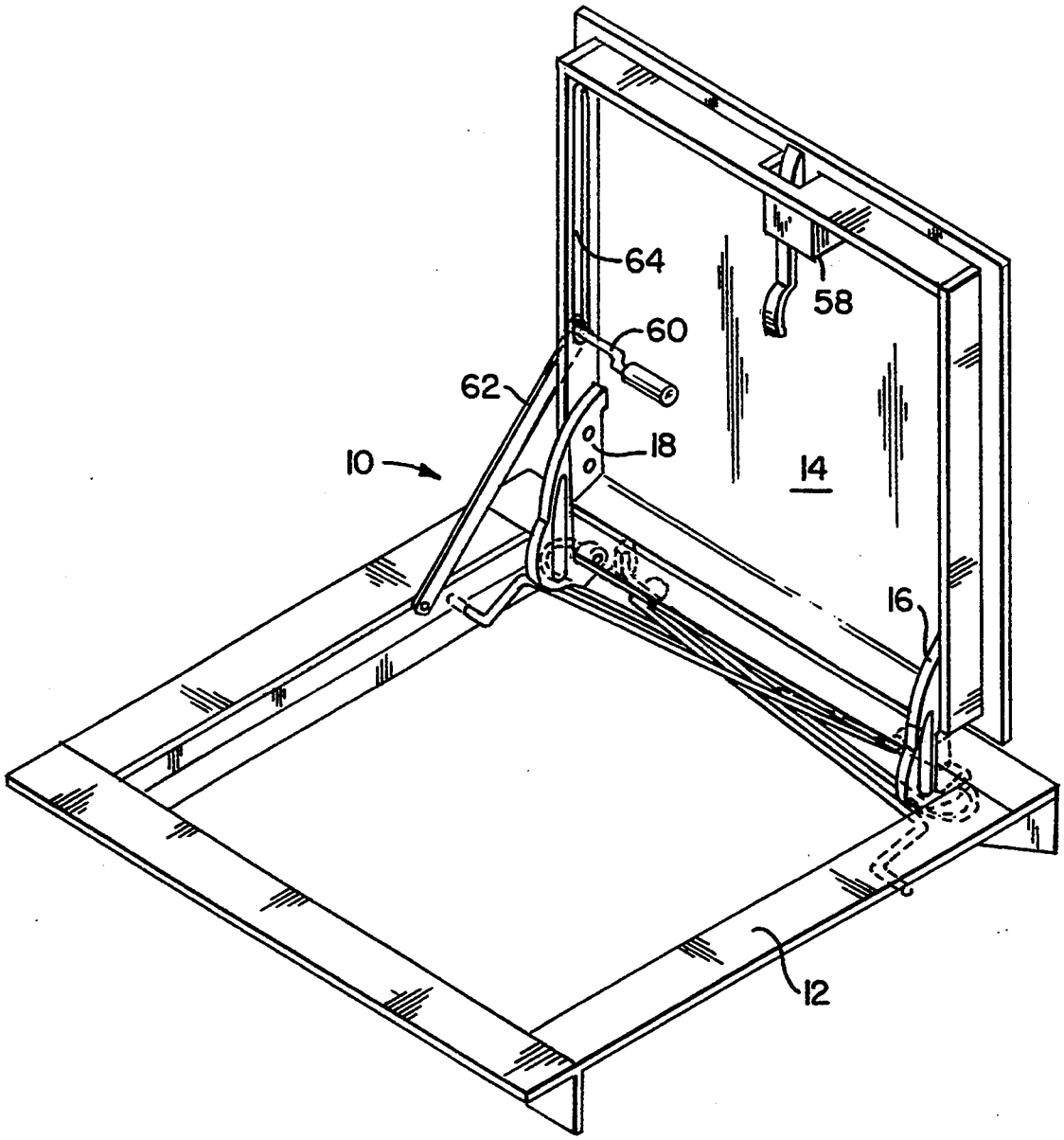
FIG. 1 is a perspective view of a horizontally hinged door and frame assembly incorporating the counterbalancing mechanism of the present invention.

FIG. 1 shows a perspective view of a door assembly incorporating the augmented counterbalancing system of the present invention. The door assembly 10 includes a frame 12 and a door 14 hinged along a non-vertical hinge axis by gooseneck hinges 16 and 18 shown at an enlarged scale in FIG. 6. Gooseneck hinges 16 and 18 are fastened to the door 14 and rotate about hinge pins 28, 30 extending through opening 20 in the hinge (see FIG. 6) and into a corresponding opening in hinge mount 22.

Figure 7:
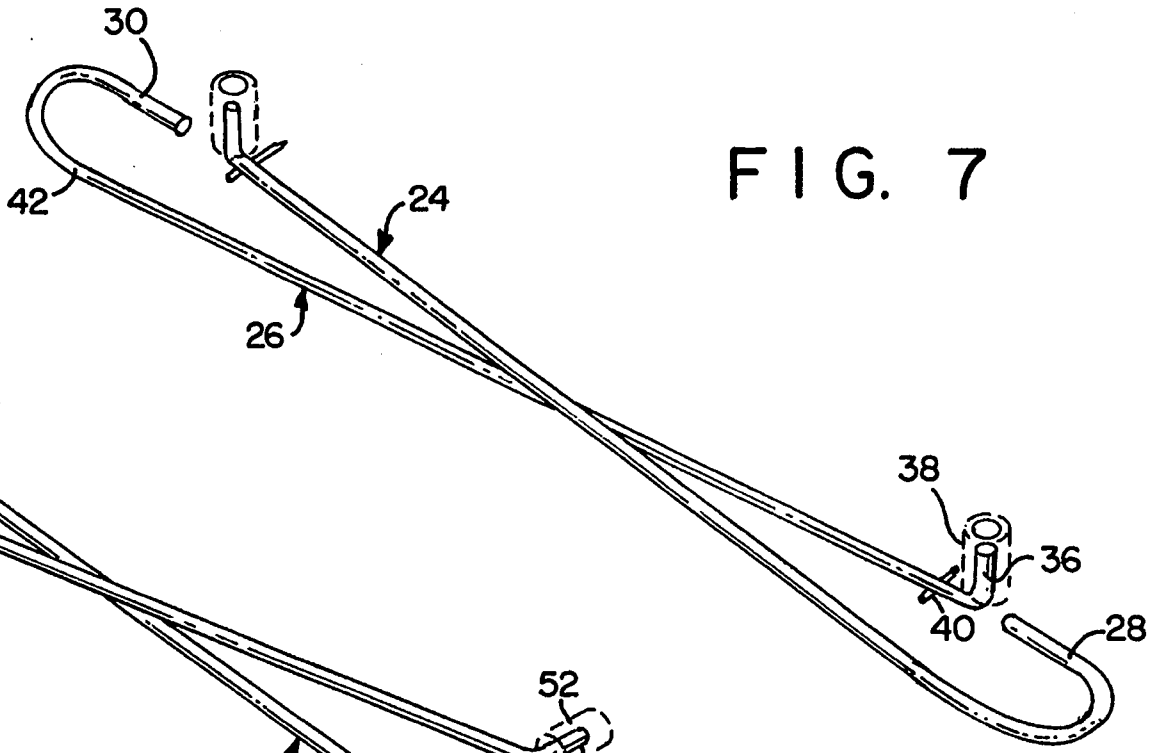
FIG. 7 is a perspective view of first and third torque rods from FIG. 1 which act directly between the door and frame to produce partial counterbalancing of the door.

In the preferred design the hinge pins 28, 30 are part of the direct connection torque rods 24, 26 (seen in FIG. 7). They are formed by the end of the torque rods 24, 26 which are reverse curved to engage their corresponding hinge leaf with a direct connection that also acts as a hinge pin. The door assembly illustrated in FIG. 1 includes four (4) torque rods 24, 26, 32 and 34, shown individually in FIGS. 7 and 8. Torque rods 24 and 26 form a first counterbalancing means which produces the linear counterbalancing force through direct connection between the door and frame. Torque rods 32 and 34 form a second counterbalancing means which produce an augmenting counterbalancing force by acting between the door and frame through corresponding cam surfaces on the gooseneck hinges.

Figure 6:
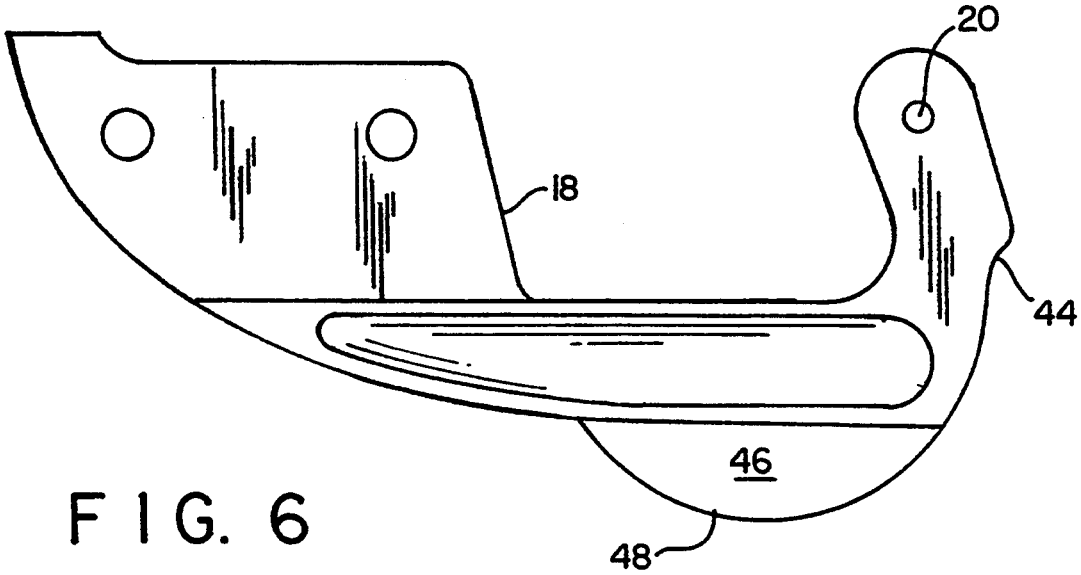
FIG. 6 is a detail side elevational view at an enlarged scale of a gooseneck hinge leaf of the type seen in FIGS. 1–5 with an integral cam and cam surface.

The gooseneck hinge design of hinges 16 and 18 in FIG. 6 permit the hinge point to be located underneath the frame 12 and still allow the door to reach the fully open position.

Figure 8:
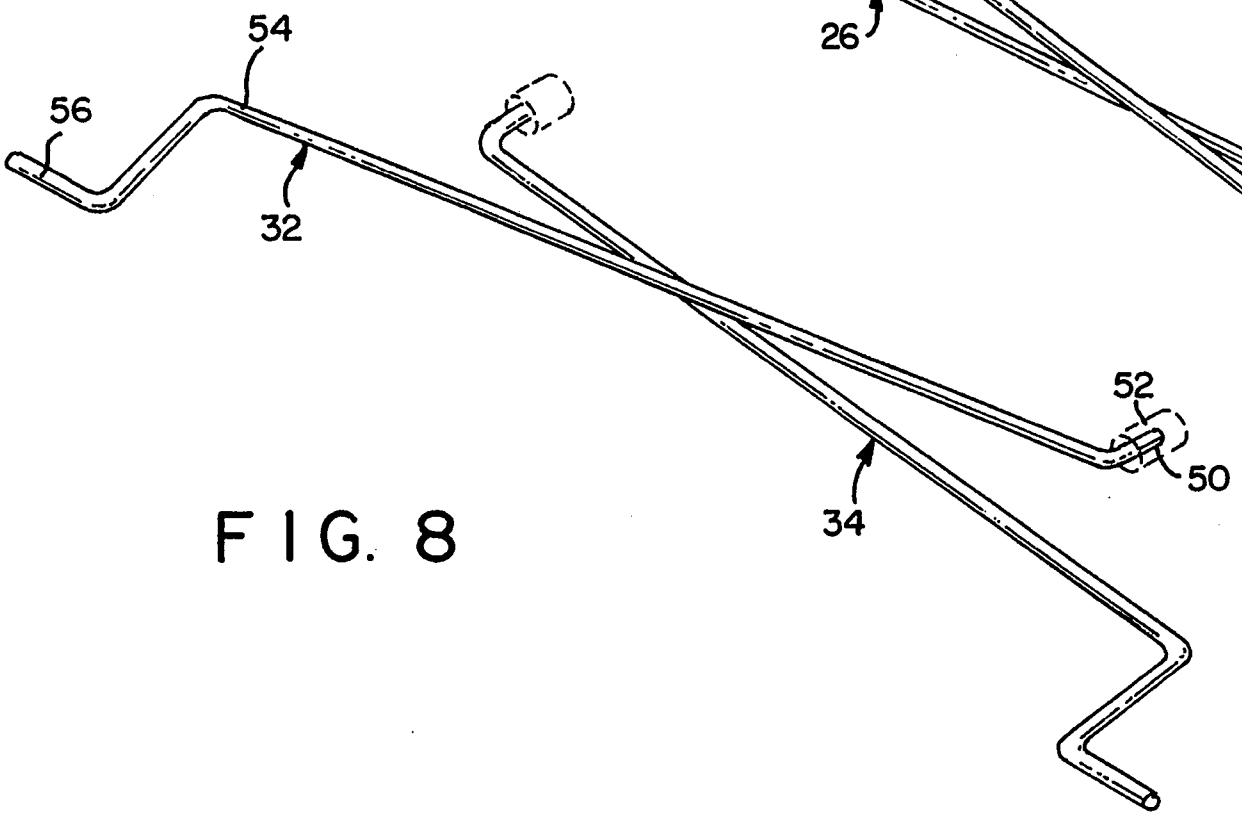
FIG. 8 is a perspective view of second and fourth torque rods from FIG. 1 which act through the cam surfaces of two gooseneck hinge as seen in FIG. 6 to produce the augmenting counterbalancing of the door.

Referring to FIG. 7, torque rod 26 is a mirror image of torque rod 24. Referring to FIG. 8, torque rod 32 is a mirror image of torque rod 34. First torque rod 26 and second torque rod 32 act upon gooseneck hinge 18 in the same way that their mirror images, third torque rod 24 and fourth torque rod 34 act upon gooseneck hinge 16. As such, each hinge 16, 18 has fifty percent of the total counterbalancing torque applied through it. Due to this symmetry, and for the sake of clarity, in the cross sectional views of FIGS. 2 through 5 the third and fourth torque rods 24, 34 have been eliminated and only the first and second torque rods 26 and 32 have been shown.

Figure 2:
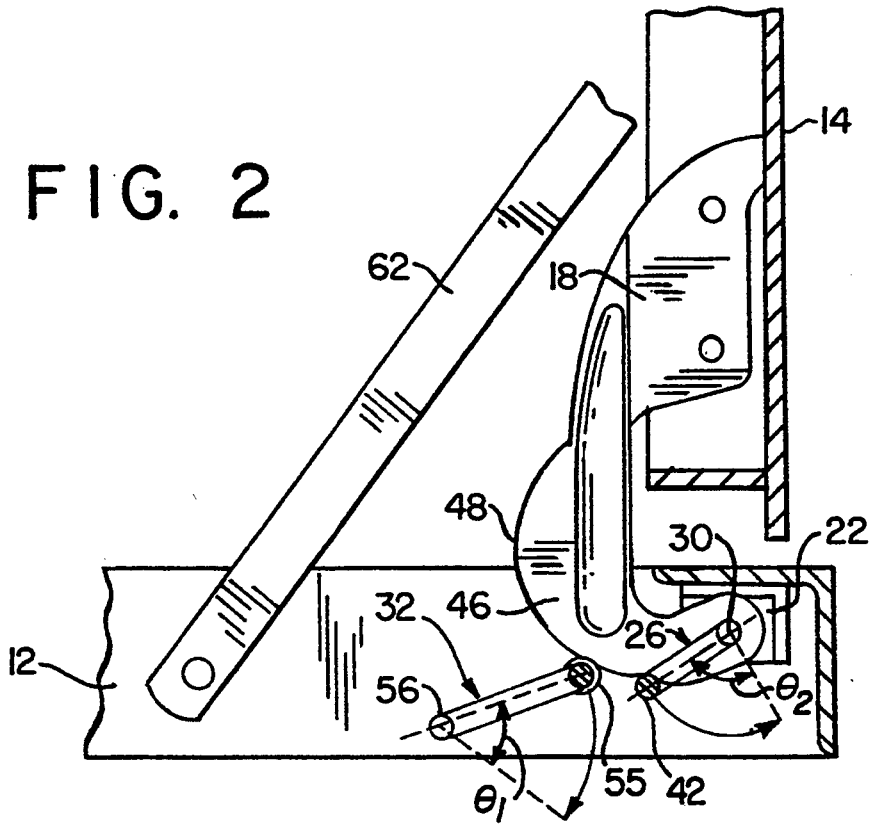
FIG. 2 is a detail side elevational view, partly in section, of a portion of the hinge mechanism and counterbalancing assembly showing the door of FIG. 1 in the fully open position.

Referring to FIGS. 1, 2 and 7, the first torque rod 26 is connected at its opposite ends between the door and the frame by means of an upturned end 36 attached to the frame 12 and a recurved end 30, 42 which engages hinge 18 on the door. The upturned end 36 is held in a holder 38, which is permanently fastened to the frame 12 and is retained therein by pin 40. The recurred end includes a 180° bend from portion 42 to portion 30.

Portion 30, as previously described, passes through hole 20 in hinge 18 and acts as a hinge pin along the hinge axis. Portion 42 is engaged by recess 44 in hinge 18. In this way, the end 30, 42 is non-rotatably connected to the door through hinge 18, and the other end 36 is non rotatably connected to the frame.

Figure 5:
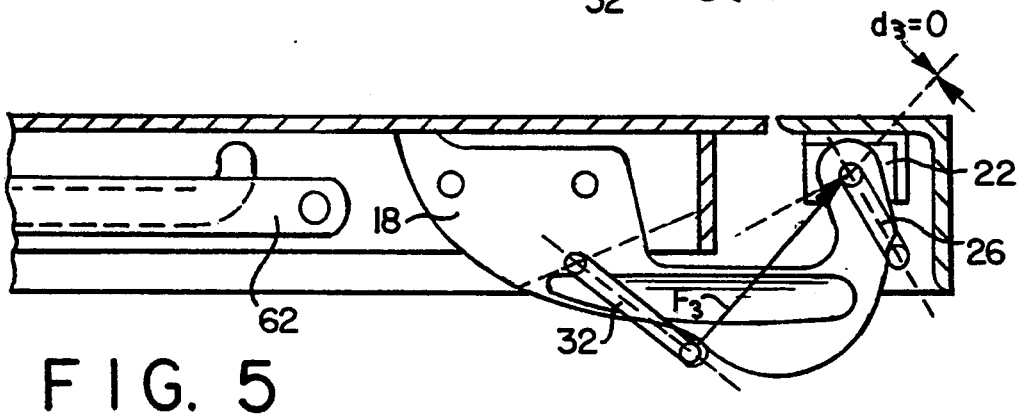

This direct connection between the frame and the door causes torque rod 26 to be twisted linearly as the door moves from the fully open position of FIG. 2 (torque rod 26 untwisted) to the fully closed position of FIG. 5 (torque rod 26 twisted to its maximum extent). The length of torque rod 26 and its diameter are selected such that the door is approximately fully counterbalanced when the door reaches the fully closed position shown in FIG. 5. Fifty percent of the counterbalancing torque is, of course, provided by torque rod 26 and fifty percent of the counterbalancing torque at this position is provided by mirror image torque rod 24.

As described above, even in the absence of torque rods 32 and 34, the door will be nearly perfectly counterbalanced at the fully open position shown in FIG. 2 and the fully closed position shown in FIG. 5 by torque rods 24 and 26. Thus, at these two positions, the torque rods 32 and 34 produce no augmenting counterbalancing torque. However, at the intermediate positions shown in FIGS. 3 and 4, the door is only partially counterbalanced by torque rods 24 and 26 and torque rods 32 and 34 must produce an augmenting torque that varies non-linearly with the opening angle to produce the additional torque needed to produce near perfect counterbalancing throughout the arc of motion of the door.

This augmenting torque is produced by modifying the force from the torque rods 32 and 34 through cams on hinges 16, 18 to produce the desired counterbalancing torque. Referring to FIGS. 2 and 6, hinges 16, 18 include a cam portion 46 having a cam surface 48.

Referring to FIG. 8, torque rod 32 includes a bent end 50 mounted in a holder 52 which, like holder 38, is permanently affixed to the frame 12. The other end of torque rod 32 includes a double bend from portion 54 to 56. Portion 54 contacts the cam surface 48 on the hinge 18 and portion 56 is inserted into an opening in the frame 12 to form a rotating connection relative to the frame 12. As the door 14 moves from the open position in FIG. 2 to the closed position in FIG. 5, the cam surface 48 presses down against portion 54 of torque rod 32 causing it to rotate about end 56. This rotation defines a second axis of rotation through portion 56.

As indicated in FIGS. 2–5, torque rod 32 rotates clockwise as torque rod 26 rotates counter-clockwise. As the door closes, the cam surface 48 rotates portion 54 around end 56 twisting the torque rod 32. This twist generates an augmenting counterbalancing force $F_1$–$F_3$ at each of the opening angles in FIGS. 3–5 which is exerted in a normal direction to the cam surface 48.

The counterbalancing force is directed by the shape of cam surface 48 to act at a distance d from the first hinge axis. The distance d is the perpendicular distance between the hinge axis of the door and the line of force defined by the normal to the cam surface at the point of contact 54 with the torque rod 32. This relationship produces an augmenting counterbalancing torque about the hinge axis which is the product of the augmenting counterbalancing force times the distance d.

This product of force times distance varies exactly as required to augment the partial counterbalancing torque produced by torque rod 26. This may be more easily seen by reference to the drawings and angles in FIGS. 2 through 5. In the fully open position, the door is balanced over the hinge axis and neither the first torque rod 26 nor the second torque rod 32 is twisted. As the door 14 swings 90° to the closed position, torque rod 26 will also rotate 90° as indicated by the angle $\theta_2$. However, torque rod 32 rotates less than 90° by virtue of the relationship with the cam. The maximum angle of rotation of torque rod 32 is shown as $\theta_1$ in FIG. 2.

Figure 3:
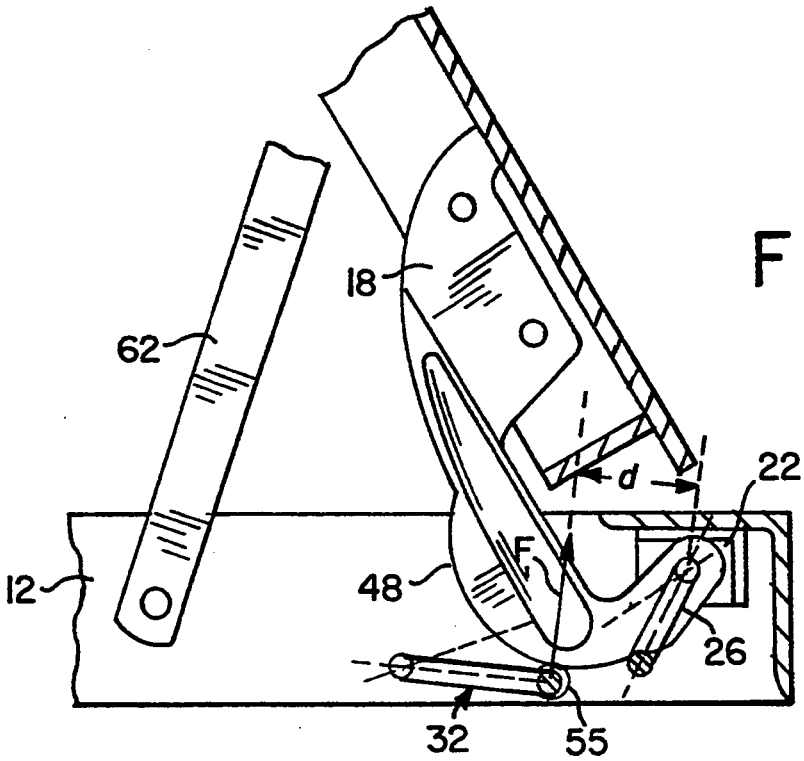
FIGS. 3, 4 and 5 are side elevational views, partly in section, corresponding to FIG. 2, but showing the door at different opening angle positions as the door moves from the fully open position in FIG. 2 to the fully closed position of FIG. 5.
Figure 4:
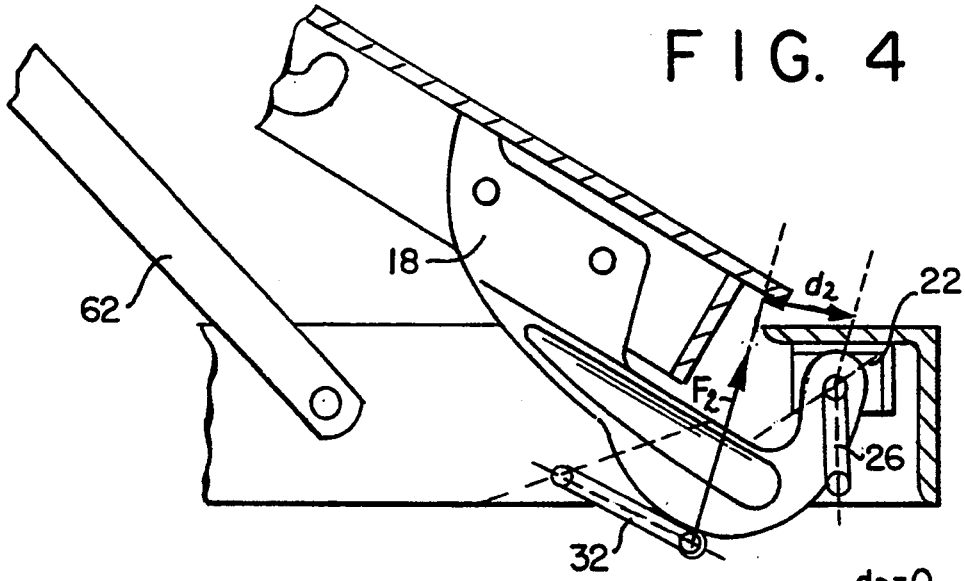

At the first intermediate position shown in FIG. 3, torque rod 32 has begun to twist producing a small counterbalancing force $F_1$ acting at a distance $d_1$ from the first hinge axis. In FIG. 4, the door has closed further causing an increase in the counterbalancing force $F_2$ acting at a new distance $d_2$ to produce new counterbalancing torque. In FIG. 5, the door has reached the fully closed position and torque rod 32 has reached its maximum angle of twist producing a maximum force $F_3$. However, the shape of cam surface 48 is such that $F_3$ is aimed directly towards the hinge axis of the door. Thus, the distance $d_3$ is zero producing a net augmenting counterbalancing force of zero at this angle.

In this way, the augmenting counterbalancing torque rod produces a counterbalancing torque which is a minimum at the fully opened position, reaches a maximum at an intermediate position, and decreases to another minimum as the door reaches the fully closed position. This is exactly the augmenting force needed to fill in the missing counterbalancing torque from the partial counterbalancing provided by torque rods 24 and 26.

The torque rod 32 may be allowed to directly contact the cam surface 48 at point 54, however, the sliding friction and wear can be reduced and door operation made quieter by snapping a plastic sleeve 55 around the torque rod 32 at point 54. Alternatively, a wheel may be mounted around the torque rod at this point.

The door and frame of FIG. 1 also show a latch mechanism 58, a hold open arm 62 and a handle 60 which slides in a track 64. Alternative designs for these elements would also be suitable and will vary depending on the type of door and the desired locking and closing mechanisms.

Thus, having described the invention, what is claimed is:

What is claimed is:

1. A door assembly with augmented counterbalancing comprising:

a frame;

a door hingedly connected to the frame along a non-vertical hinge axis for motion from an open position to a closed position;

a first counterbalancing means connected between the door and the frame, the first counterbalancing means producing a substantially linear partial counterbalancing torque about the hinge axis;

a cam having a cam surface; and a second counterbalancing means applying a force to the cam surface, the cam and the second counterbalancing means acting together as an augmenting counterbalancing unit, the augmenting counterbalancing unit being connected between the door and the frame to produce a non-linear augmenting counterbalancing torque about the hinge axis, the sum of the partial and augmenting counterbalancing torques substantially counterbalancing the door throughout an arc of motion between the open and the closed positions.

2. A door assembly according to claim 1 wherein the first counterbalancing means includes a first torque rod and the second counterbalancing means includes a second torque rod, the first and second torque rods twisting as the door swings from the open to the closed position.

3. A door assembly according to claim 2 wherein the first and second torque rods twist in opposite directions as the door swings from the open to the closed position.

4. A door assembly according to claim 2 wherein the second torque rod has a first end non-rotatably connected to the frame and a second end rotatably connected to the frame for rotation about a second axis offset from the hinge axis.

5. A door assembly according to claim 4 wherein the second torque rod is bent outward from the second axis and contacts the cam surface at a point displaced from the second axis.

6. A door assembly according to claim 2 further including a second cam having a second cam surface and wherein:

the first counterbalancing means includes the first torque rod and a third torque rod connected between the door and the frame, the third torque rod twisting as the first torque rod twists; and the second counterbalancing means includes the second torque rod and a fourth torque rod applying a force to the second cam surface, the fourth torque rod twisting as the second torque rod twists.

7. A door assembly according to claim 6 wherein the first and third torque rods are bent at one end, the bent portion of each torque rod passing through the hinge axis forming hinge pins between the door and the frame.

8. A door assembly according to claim 7 wherein each of the first and second cams is integrally formed as part of a hinge attached to the door for hinging the door to the frame along the hinge axis.

9. A door assembly according to claim 8 wherein the hinges are formed as gooseneck hinges with the hinge axis being located beneath a portion of the frame when the frame is mounted horizontally.

10. A door assembly according to claim 1 wherein the first counterbalancing means generates a partial counterbalancing torque that is linearly related to an opening angle measured about the hinge line between the door and the frame, and the second counterbalancing means generates an augmenting counterbalancing torque through the cam that is sinusoidally related to the opening angle, the sum of the partial counterbalancing and augmenting counterbalancing torques substantially counter-balancing the door at all angles between the open and the closed positions.

11. A door assembly according to claim 10 wherein the second counterbalancing means generates an augmenting counterbalancing torque that reaches a maximum at an intermediate position between the open and the closed positions.

12. A door assembly according to claim 11 wherein the second counterbalancing means generates an augmenting counterbalancing torque that is approximately zero at the open and the closed positions.

13. A door assembly with augmented counterbalancing comprising:

a frame;

a door hinged to the frame along a hinge axis for motion from an open to a closed position;

a first torque rod connected between the door and the frame, the first torque rod twisting as the door swings between the open and the closed position to produce a partial counterbalancing torque about the hinge axis;

a second torque rod; and a cam having a cam surface;

the second torque rod and cam acting together as an augmenting counterbalancing unit, the augmenting counterbalancing unit being connected between the door and the frame, the cam surface contacting and twisting the second torque rod in an opposite direction from the first torque rod to produce and augmenting counterbalancing torque about the hinge axis.

14. A door assembly according to claim 13 further including a second cam, a third torque rod and a fourth torque rod, the third torque rod twisting as the first torque rod twists, the fourth torque rod and second cam being connected between the door and the frame with the second cam surface contacting and twisting the fourth torque rod as the door swings between the open and the closed position.

15. A door assembly according to claim 14 wherein the first and third torque rods are bent at one end, the bent portion of each torque rod passing through the hinge axis forming hinge pins between the door and the frame.

16. A door assembly according to claim 15 wherein each of the first and second cams is integrally formed as pad of a hinge attached to the door for hinging the door to the frame along the hinge axis.

17. A door assembly according to claim 16 wherein the hinges are formed as gooseneck hinges with the hinge axis being located beneath a portion of the frame when the frame is mounted horizontally.

18. A door assembly according to claim 13 wherein the second torque rod has a first end non-rotatably connected to the frame and a second end rotatably connected to the frame for rotation about a second axis offset from the hinge axis.

19. A door assembly according to claim 18 wherein the second torque rod is bent outward from the second axis and contacts the cam surface at a point displaced from the second axis.

20. A door assembly with augmented counterbalancing comprising:

a frame;

a hinge;

a door hinged to the frame by the hinge along a non-vertical hinge axis for motion from an open position to a closed position;

a first counterbalancing means connected between the door and the frame to produce a partial counterbalancing torque about the hinge axis which is linearly related to the angle between the door and the frame;

a cam having a cam surface; and a second counterbalancing means applying a force to the cam surface, the cam and the second counterbalancing means acting together as an augmenting counterbalancing unit, the augmenting counterbalancing unit being connected between the door and the frame to produce an augmenting counterbalancing torque about the hinge axis which is sinusoidally related to the angle between the door and the frame, the sum of the partial and augmenting counterbalancing torques substantially counterbalancing the door throughout an arc of motion between the open and the closed positions.

21. A door assembly according to claim 20 wherein the first counterbalancing means includes a first torque rod and the second counterbalancing means includes a second torque rod, the first and second torque rods twisting in opposite directions as the door swings from the open to the closed position.

22. An augmenting counterbalancing assembly for a partially counterbalanced door hinged to a frame comprising:

an augmenting torque rod adapted for fixed connection at one end to the frame and rotating connection at the other end to the frame; and a cam adapted for connection to the door, the cam having a cam surface which twists the augmenting torque rod from a first minimum twist angle to a maximum twist angle and back to a second minimum twist angle as the door swings from an open position through an intermediate position to a closed position, the augmenting torque rod being twisted in the opposite direction from the door as the door swings from the open to the closed position.

* * * * *

UNITED STATES PATENT AND TRADEMARK OFFICE

CERTIFICATE OF CORRECTION

PATENT NO. : 5,373,665

DATED : December 20, 1994

INVENTOR(S) : Robert J. Lyons, Sr.

It is certified that error appears in the above-identified patent and that said Letters Patent is hereby corrected as shown below:

Column 4, Line 52: "recurred" should read - - recurved - - .

Column 8, Line 10, Claim 16: "pad" should read - - part - -.

Signed and Sealed this

Seventh Day of March, 1995

*Attest:*

*Attesting Officer*

BRUCE LEHMAN

*Commissioner of Patents and Trademarks*